US009966212B2

(12) United States Patent
Sumino et al.

(10) Patent No.: US 9,966,212 B2
(45) Date of Patent: May 8, 2018

(54) BLINKING DEVICE

(71) Applicant: Panasonic Intellectual Property Management Co., Ltd., Osaka (JP)

(72) Inventors: Yasuhiro Sumino, Mie (JP); Kiwamu Shibata, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 438 days.

(21) Appl. No.: 14/648,695

(22) PCT Filed: Dec. 6, 2013

(86) PCT No.: PCT/JP2013/007173
§ 371 (c)(1),
(2) Date: May 29, 2015

(87) PCT Pub. No.: WO2014/097566
PCT Pub. Date: Jun. 26, 2014

(65) Prior Publication Data

US 2015/0371799 A1 Dec. 24, 2015

(30) Foreign Application Priority Data

Dec. 21, 2012 (JP) ..... 2012-280230

(51) Int. Cl.
*H01H 47/00* (2006.01)
*H01H 85/041* (2006.01)
(Continued)

(52) U.S. Cl.
CPC ..... *H01H 47/00* (2013.01); *H01H 47/002* (2013.01); *H01H 2009/545* (2013.01);
(Continued)

(58) Field of Classification Search
CPC ..... H01H 47/00
(Continued)

(56) References Cited

U.S. PATENT DOCUMENTS

2002/0170732 A1 11/2002 Chiriku et al.
2003/0126253 A1* 7/2003 Ewing ..... G06F 1/26 709/223
(Continued)

FOREIGN PATENT DOCUMENTS

JP S57-034902 U1 8/1980
JP H01-061806 U1 4/1984
(Continued)

OTHER PUBLICATIONS

English translation of Chinese Office Action dated Jan. 18, 2017 issued in Chinese Patent Application No. 201380062695.X.
(Continued)

*Primary Examiner* — Joseph Chang
(74) *Attorney, Agent, or Firm* — McDermott Will & Emery LLP

(57) ABSTRACT

The blinking device includes multiple power terminals, multiple load terminals, multiple contact switches, a control circuit, and multiple mounting substrates, and a case in a box shape for accommodating these therein. The multiple contact switches are individually associated with multiple power supply paths individually connected to multiple pairs each defined as a pair of one power terminal of the multiple power terminals and one load terminal of the multiple load terminals. At least one power supply path of the multiple power supply paths is formed on at least one of a front face, where at least one contact switch is mounted, and a rear face, where no contact switch is mounted, of each of the multiple mounting substrates. The case is configured to accommodate the multiple mounting substrates so that the multiple mounting substrates are stacked in a thickness direction.

13 Claims, 10 Drawing Sheets

(51) Int. Cl.
*H01H 9/54* (2006.01)
*H01H 47/02* (2006.01)

(52) U.S. Cl.
CPC ..... *H01H 2047/025* (2013.01); *H01H 2085/0412* (2013.01)

(58) Field of Classification Search
USPC ..... 307/96
See application file for complete search history.

(56) References Cited

U.S. PATENT DOCUMENTS

| | | | | |
|---|---|---|---|---|
| 2008/0130224 | A1 | 6/2008 | Hashikura et al. | |
| 2009/0098749 | A1 | 4/2009 | Hashikura et al. | |
| 2010/0264831 | A1* | 10/2010 | Nagaoka ..... | H05B 33/0851 315/149 |
| 2012/0194106 | A1* | 8/2012 | Hille ..... | A47C 20/041 318/3 |

FOREIGN PATENT DOCUMENTS

| | | | |
|---|---|---|---|
| JP | 05-054772 | A | 3/1993 |
| JP | H06-068161 | A | 3/1994 |
| JP | 06-46528 | B2 | 6/1994 |
| JP | 09-289282 | A | 11/1997 |
| JP | H09-312123 | A | 12/1997 |
| JP | 2001-229760 | A | 8/2001 |
| JP | 2002-352680 | A | 12/2002 |
| JP | 2008-141930 | A | 6/2008 |
| JP | 2009-037947 | A | 2/2009 |
| JP | 2009-110718 | A | 5/2009 |
| JP | 2011-119228 | A | 6/2011 |

OTHER PUBLICATIONS

International Search Report issued in International Application No. PCT/JP2013/007173 dated Jan. 14, 2014, with English Translation.

* cited by examiner

BLINKING DEVICE

RELATED APPLICATIONS

This application is a National Phase of International Application No. PCT/JP2013/007173, filed on Dec. 6, 2013, which in turn claims the benefit of Japanese Application No. 2012-280230, filed on Dec. 21, 2012, the disclosures of which Applications are incorporated by reference herein.

TECHNICAL FIELD

The present invention relates to blinking devices, and in particular relates to a blinking device for blinking lighting loads.

BACKGROUND ART

Document 1 (JP 2011-119228 A) discloses a conventional blinking device which is a hybrid relay. This conventional example includes a mechanical contact switch whose contacts are to be opened and closed by a driver, and a semiconductor switch connected in parallel with this contact switch. Further, a power supply path for supplying power from an AC power source to a load includes a parallel circuit of a first power supply path including the contact switch and a second power supply path including the semiconductor switch.

In a process of starting power supply from the AC power source to the load, first the semiconductor switch is turned on, and therefore power supply from the AC power source to the load is started. After the contact switch is turned on, power is supplied from the AC power source to the load through the contact switch, and the semiconductor switch is turned off.

To independently start and end power supply to multiple loads, the conventional example disclosed in document 1 includes multiple circuits (four circuits) each including a mechanical contact switch and a semiconductor switch. The contact switches and the semiconductor switches of these four circuits are mounted on the same face of one printed wiring board, and are accommodated in a case which is a synthetic resin molding product.

However, to mount the contact switches and the semiconductor switches of the multiple circuits on the same face of one printed wiring board as with the conventional example disclosed in document 1, it may be necessary to increase a size of the printed wiring board. Such an increase in a size of the printed wiring board is likely to cause an increase a size of the case for accommodating the printed wiring board.

SUMMARY OF INVENTION

In view of the above insufficiency, the objective of the present invention is to allow independent starting and ending of power supply to multiple loads, and also allow downsizing.

The blinking device of the first aspect in accordance with the present invention, includes: multiple power terminals to be connected to a power supply; multiple load terminals to be individually connected to different loads; multiple contact switches individually associated with multiple power supply paths individually connected to multiple pairs each defined as a pair of one power terminal of the multiple power terminals and one load terminal of the multiple load terminals; a control circuit for turning on and off the multiple contact switches; multiple mounting substrates each on which at least one contact switch of the multiple contact switches is mounted; and a case in a box shape for accommodating therein the multiple power terminals, the multiple load terminals, the control circuit, and the multiple mounting substrates.

At least one power supply path of the multiple power supply paths is formed on at least one of a front face, where at least one contact switch is mounted, and a rear face, where no contact switch is mounted, of each of the multiple mounting substrates. The case is configured to accommodate the multiple mounting substrates so that the multiple mounting substrates are stacked in a thickness direction.

In the blinking device of the second aspect in accordance with the present invention realized in combination with the first aspect, the case is configured to accommodate adjacent two mounting substrates of the multiple mounting substrates so that the rear faces of the adjacent two mounting substrates face each other.

In the blinking device of the third aspect in accordance with the present invention realized in combination with the first aspect, each of the multiple power terminals includes a power supply dedicated terminal plate to be connected to a power supply cable (not shown), and an insertion part inserted into through holes individually penetrating through the multiple mounting substrates in a thickness direction. Each of the multiple load terminals includes a load dedicated terminal plate to be connected to a load cable (not shown), and an insertion part inserted into through holes individually penetrating through the multiple mounting substrates in a thickness direction. Each of the multiple mounting substrates includes a connector electrically connected to the at least one power supply path. The connector of one mounting substrate allows insertion of an insertion part from a different mounting substrate and is electrically connected to the insertion part from the different mounting substrate.

In the blinking device of the fourth aspect in accordance with the present invention realized in combination with the second aspect, an insulating member is situated between the two mounting substrates.

In the blinking device of the fifth aspect in accordance with the present invention realized in combination with the third aspect, the through hole of one mounting substrate of adjacent two mounting substrates of the multiple mounting substrates exposes the connector of the other mounting substrate.

In the blinking device of the sixth aspect in accordance with the present invention realized in combination with the second aspect, the blinking device further includes a spacer for keeping a distance between the two mounting substrates constant.

In the blinking device of the seventh aspect in accordance with the present invention realized in combination with the first aspect, the blinking device further includes a control substrate. Multiple circuit parts constituting the control circuit are mounted on the control substrate. A conduction path electrically interconnecting the multiple circuit parts is formed on a surface of the control substrate. Each of the multiple power supply paths is made of a copper foil thicker than a copper foil for forming the conduction path.

In the blinking device of the eighth aspect in accordance with the present invention realized in combination with the first aspect, a semiconductor switch connected in parallel with a corresponding one of the multiple contact switches is mounted on each of the multiple mounting substrates.

In the blinking device of the ninth aspect in accordance with the present invention realized in combination with the eighth aspect, the blinking device further includes a temperature sensing element for sensing a temperature of the semiconductor switch. The semiconductor switch is situated so that a length direction of the semiconductor switch is parallel with the front face of a corresponding one of the multiple mounting substrates. The temperature sensing element is mounted on the front face of the corresponding one of the multiple mounting substrates with the semiconductor switch in-between so that a length direction of the temperature sensing element is parallel with the front face of the corresponding one.

In the blinking device of the tenth aspect in accordance with the present invention realized in combination with the ninth aspect, the semiconductor switch includes a face which faces the front face of the corresponding one of the multiple mounting substrates and is in contact with this front face.

In the blinking device of the eleventh aspect in accordance with the present invention realized in combination with the ninth aspect, the blinking device further includes: an overvoltage protection element for protecting the semiconductor switch from overvoltage; and a second temperature sensing element for sensing a temperature of the overvoltage protection element.

In the blinking device of the twelfth aspect in accordance with the present invention realized in combination with the eleventh aspect, the temperature sensing element doubles as the second temperature sensing element.

In the blinking device of the thirteenth aspect in accordance with the present invention realized in combination with the first aspect, at least one patterned copper foil including the at least one multiple power supply paths is formed on each of the front face and the rear face of each of the multiple mounting substrates.

DESCRIPTION OF EMBODIMENTS

Figure 2:
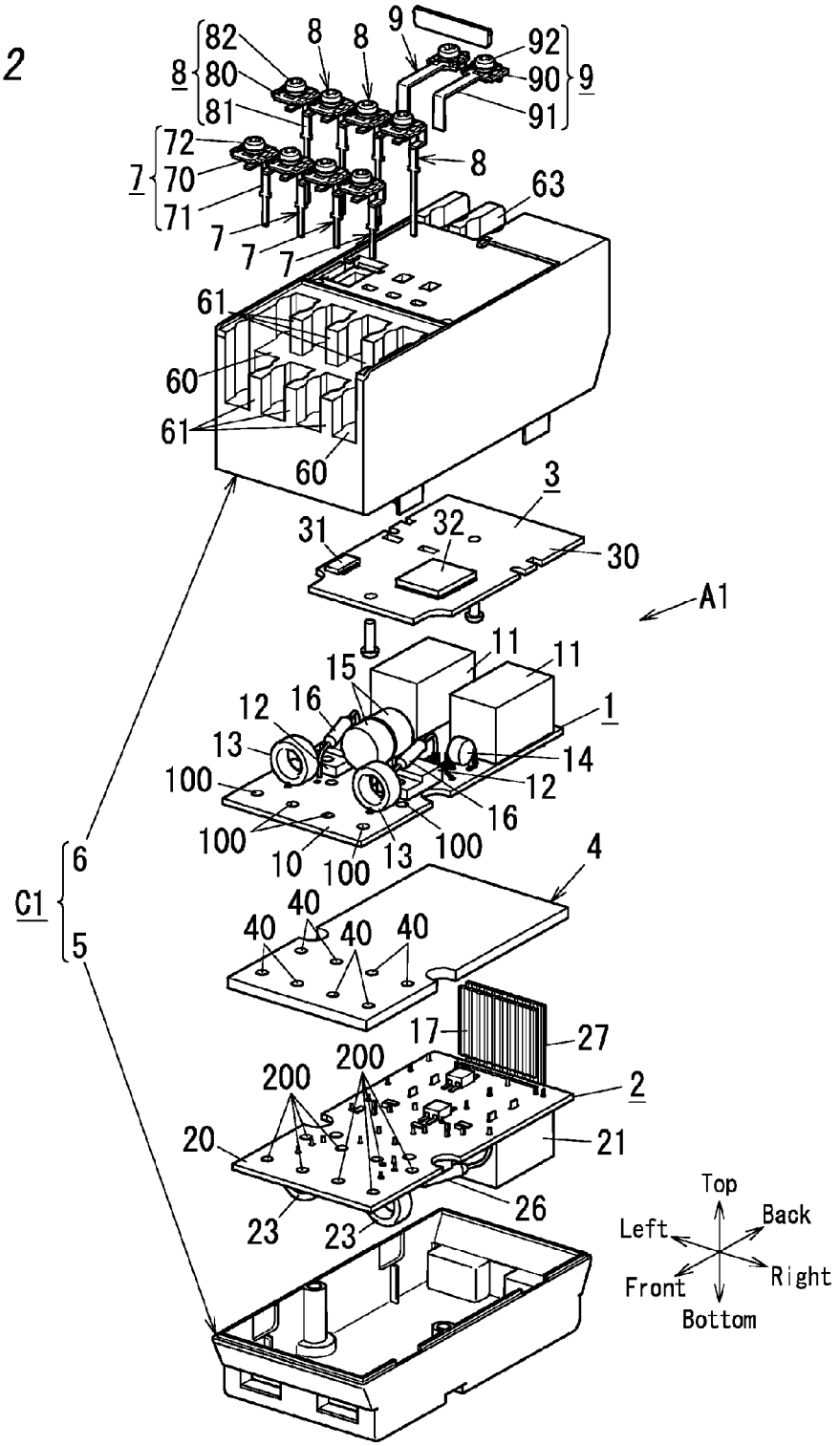
FIG. 2 is an exploded perspective view illustrating the blinking device in accordance with the embodiment of the present invention.

The blinking device A1 in accordance with one embodiment of the present invention is described in detail with reference to attached drawings. As shown in FIG. 2, the blinking device A1 of the present embodiment may include a first switch block 1, a second switch block 2, a control circuit block 3, an insulating member 4, a case C1, four power terminals 7, four load terminals 8, and two signal terminals 9. Note that, the following explanations are made based on upper, lower, front, rear, left and right directions defined by arrows shown in FIG. 2.

The case C1 is assembled by coupling a body 5 and a cover 6 with each other. The body 5 is made of synthetic resin material and has a rectangular box shape with an open upper face. The cover 6 is made of synthetic resin material and has a rectangular box shape with an open lower face. An upper end of the body 5 and a lower end of the cover 6 are made to be in contact with each other, and two fixing screws (not shown) are screwed from a lower side of the body 5, and thereby the body 5 and the cover 6 are coupled with each other. As a result, the case C1 is assembled. Note that, the cover 6 is about several times as large as the body 5 in a height which is a dimension in an upper and lower direction.

There are two mounting rests 60 provided like stairs to a front end of an upper side of the cover 6. On the lower (front) mounting rest 60, a power supply dedicated terminal plate 70 of each power terminal 7 is mounted. On the upper (rear) mounting rest 60, a load dedicated terminal plate 80 of each load terminal 8 is mounted. Further, there are some insulating walls 61 protruded in the upper and lower direction from the lower mounting rest 60, and each insulating wall insulates the power supply dedicated terminal plates 70 adjacent in the left and right direction from each other. Similarly, there are some insulating walls 61 protruded in the upper and lower direction from the upper mounting rest 60, and each insulating wall insulates the load dedicated terminal plates 80 adjacent in the left and right direction from each other. Note that, a synthetic resin terminal cover which is not shown is detachably attached to the front end of the upper side of the cover 6 for the purpose of preventing foreign matter from being in contact with the power terminals 7 and the load terminals 8.

Figure 3:
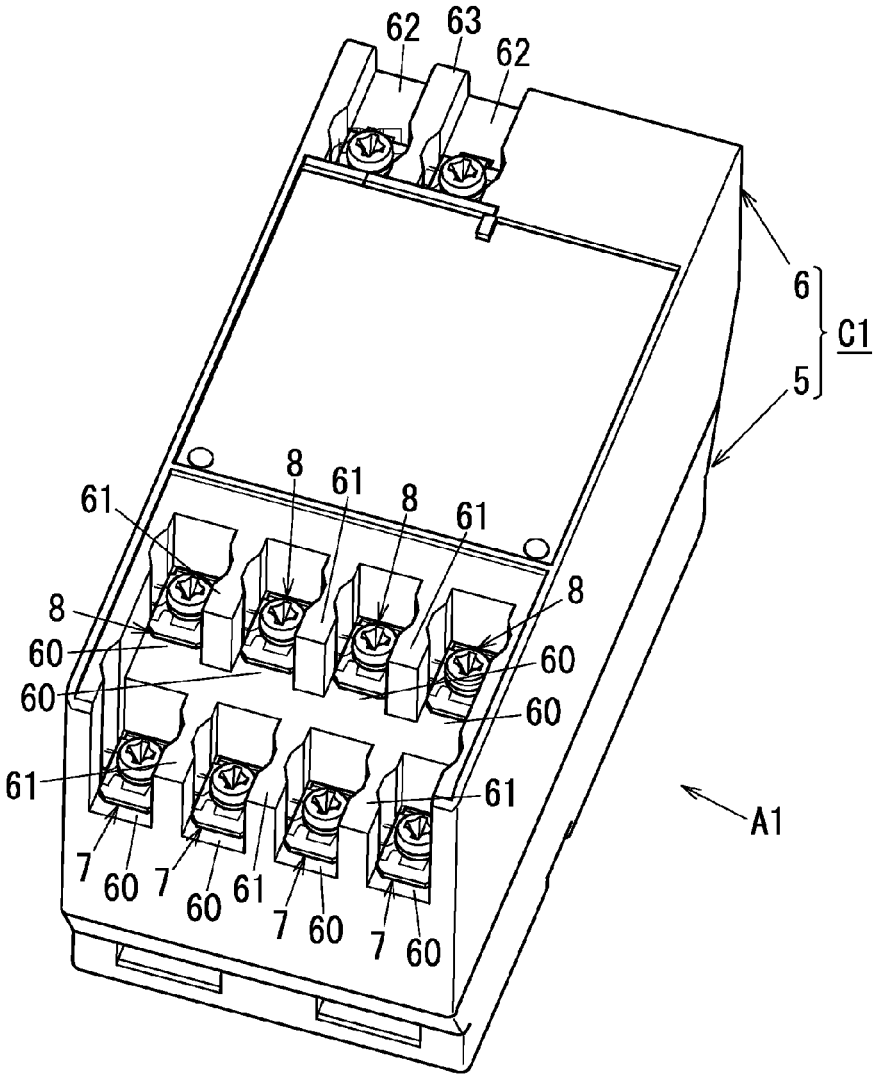
FIG. 3 is a perspective view illustrating the blinking device in accordance with the embodiment of the present invention.

Additionally, there is a mounting rest 62 provided to a left side of a rear end of the upper side of the cover 6 (see FIG. 3). On the mounting rest 62, a signal dedicated terminal plate 90 of each signal terminal 9 is mounted. Note that, there is an insulating wall 63 protruded in the upper and lower direction from the mounting rest 62, and the insulating wall insulates the signal dedicated terminal plates 90 adjacent in the left and right direction from each other.

The power terminal 7 is constituted by the power supply dedicated terminal plate 70, an insertion part 71, and a terminal screw 72. The power supply dedicated terminal plate 70 has a rectangular flat plate shape with a screw hole (not shown) penetrating through its center, and is to be connected to an electric cable (not shown). The insertion part 71 has a narrow rectangular plate shape, and extends downward from a rear end of the power supply dedicated terminal plate 70. Note that, the power supply dedicated terminal plate 70 and the insertion part 71 are formed integrally by processing a plate material of metal such as copper and a copper alloy. The power supply dedicated terminal plate 70 is mounted on the lower (front) mounting rest 60 of the cover 6. Further, the insertion part 71 is inserted into an insertion slit 600 (see FIG. 1) provided to the rear end of the mounting rest 60.

The load terminal 8 is constituted by the load dedicated terminal plate 80, an insertion part 81, and a terminal screw 82. The load dedicated terminal plate 80 has a rectangular flat plate shape with a screw hole (not shown) penetrating through its center, and is to be connected to a load cable (not shown). The insertion part 81 has a narrow rectangular plate shape, and extends downward from a rear end of the load dedicated terminal plate 80. Note that, the load dedicated terminal plate 80 and the insertion part 81 are formed integrally by processing a plate material of metal such as copper and a copper alloy. The load terminal 8 has the same structure as the power terminal 7 except the insertion part 81 is longer than the insertion part 71. The load dedicated terminal plate 80 is mounted on the upper (rear) mounting rest 60 of the cover 6. Further, the insertion part 81 is inserted into an insertion slit 600 (see FIG. 1) provided to the rear end of the mounting rest 60.

The signal terminal 9 is constituted by the signal dedicated terminal plate 90, a connection piece 91, and a terminal screw 92. The signal dedicated terminal plate 90 has a rectangular flat plate shape with a screw hole (not shown) penetrating through its center. The connection piece 91 has a narrow rectangular plate shape, and extends forward from a front end of the signal dedicated terminal plate 90, and its apex (front end) part is bent downward. The signal dedicated terminal plate 90 is mounted on the mounting rest 62 of the cover 6. Further, the connection piece 91 is inserted into an insertion slit (not shown) provided to a front end of the mounting rest 62.

The first switch block 1 may be constituted by a printed wiring board (mounting substrate) 10, at least one mechanical contact switch 11, at least one semiconductor switch 12, at least one inductor 13, at least one capacitor 14, at least one varistor (overvoltage protection element) 15, and at least one temperature fuse (temperature sensing element) 16. On a front face (upper face) of the printed wiring board 10, two contact switches 11, two semiconductor switches 12, two inductors 13, two capacitors 14, two varistors 15, and two temperature fuses 16 are mounted.

The contact switch 11 is, for example, an electromagnetic relay including a relay contacts 110 (see FIG. 6A) and an exciting coil (not shown), and is to be turned on and off in response to a control signal outputted from the control circuit block 3 as described later. The semiconductor switch 12 is a triac (bidirectional thyristor), and is to be turned on and off by the control circuit block 3 through a drive circuit X shown in FIG. 6A and FIG. 6B.

Figure 6A:
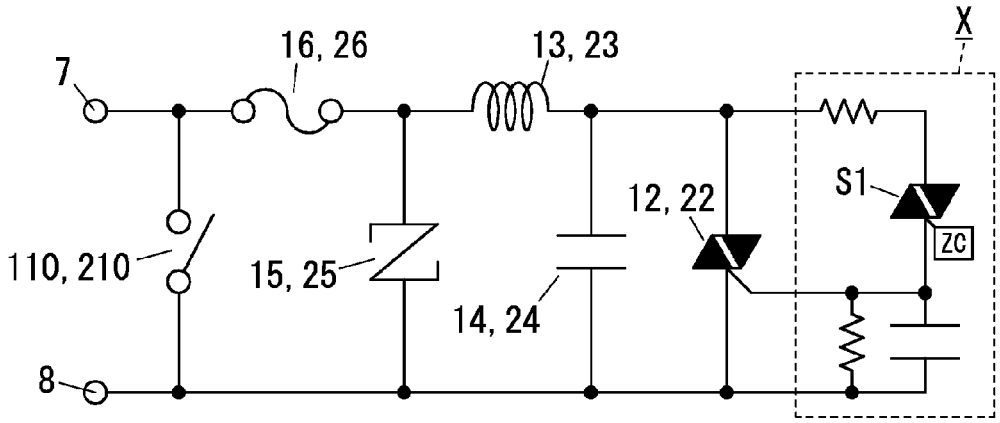
FIG. 6A is a circuit diagram of the blinking device in accordance with the embodiment of the present invention.

As shown in FIG. 6A, one of the power terminals 7 and one of the load terminals 8 form a one pair, and the relay contacts 110 of the contact switch 11 and the semiconductor switch 12 are connected in parallel with each other between the power terminal 7 and the load terminal 8 which are paired. Note that, power supply paths from the power terminals 7 to the load terminals 8 are patterned conductors (copper foils) formed on the printed wiring board 10 by printing. Note that, with regard to the blinking device A1 of the present embodiment, in some cases, depending on types of loads, a large current of several amperes may flow through the power supply paths. For this reason, it is preferable to form the power supply paths (patterned conductors) by use of a copper foil thicker than a copper foil for a conduction path (patterned conductor) of the control circuit block 3 through which a current in a range of several tens milliamperes to several hundreds milliamperes flows. For example, if the conduction path of the control circuit block 3 is 35 μm (micrometers) in thickness, it is preferable to form the power supply path by use of a copper foil with a thickness equal to or more than 150 μm (micrometers). Further, a patterned conductor is formed on the front face (upper face) of the printed wiring board 10, in addition to the rear face (lower face) of the printed wiring board 10. Note that, the patterned conductor of the printed wiring board 10 and the control circuit block 3 are electrically connected via a flat cable 17 (see FIG. 1).

Figure 6B:
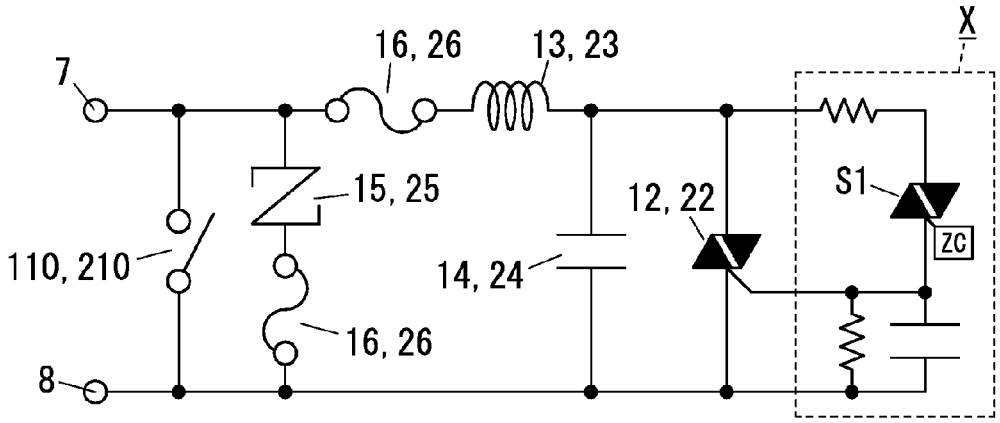
FIG. 6B is a circuit diagram of the blinking device in accordance with the embodiment of the present invention.

The power supply path between the relay contacts 110 and the semiconductor switch 12 includes a series circuit of the temperature fuse 16 and the inductor 13, and a parallel circuit of the varistor 15 and the capacitor 14. When an excess voltage (e.g., lightning surge) occurs between the power terminal 7 and the load terminal 8, the varistor 15 protects circuit parts such as the semiconductor switch 12 and the drive circuit X from an overvoltage. The inductor 13 and the capacitor 14 constitute a filter for filtering out harmonic noise from the power supply path. The temperature fuse 16 senses temperatures of the semiconductor switch 12 and the varistor 15, and fuses when one of sensed temperatues exceeds a predetermined upper limit, and thereby breaking the power supply path. Therefore, the drive circuit X, the control circuit block 3, and the like are protected from abnormally increased temperature caused by failures of the circuit parts such as the varistor 15 and the semiconductor switch 12. Note that, as shown in FIG. 6B, the temperature fuse 16 for sensing the temperature of the semiconductor switch 12 and the temperature fuse 16 for sensing the temperature of the varistor 15 may be different parts. However, when a single part is used as the temperature fuse 16 for sensing the temperature of the semiconductor switch 12 and the temperature fuse 16 for sensing the temperature of the varistor 15 as shown in FIG. 6A, it is possible to decrease the number of parts of the blinking device A1 of the present embodiment. Note that, a snubber circuit may be provided in parallel with the semiconductor switch 12.

The drive circuit X has the same configuration as a phototriac coupler of the conventional example disclosed in document 1, and may include a zero-cross type phototriac S1, and a light emitting diode (not shown) for providing an optical signal to the phototriac S1.

While the light emitting diode emits light in response to the control signal outputted from the control circuit block 3, the phototriac S1 turns on when zero-crossing of the power supply voltage (the AC voltage) occurs. When the phototriac S1 turns on, the gate voltage of the semiconductor switch 12 increases and therefore the semiconductor switch 12 turns on. Subsequently, the zero-cross type phototriac S1 turns off when zero-crossing of the power supply voltage (the AC voltage) occurs. As a result, the power supply path between the power terminal 7 and the load terminal 8 allows a current to flow through the semiconductor switch 12, and therefore power is supplied from the AC power source (not shown) to the load (not shown). Note that, the load may be a lighting fixture, an air conditioner, and a ventilation fan, or the like.

After the semiconductor switch 12 is turned on, the control signal is outputted from the control circuit block 3, and thus the contact switch 11 is turned on, and consequently power is supplied from the AC power source to the load through the contact switch 11. Note that, after the contact switch 11 is turned on, the semiconductor switch 12 is turned off by the control circuit block 3.

In contrast, to terminate power supply from the AC power source to the load, the control circuit block 3 turns off the contact switch 11 after turning on the semiconductor switch 12, and subsequently the control circuit block 3 turns off the semiconductor switch 12 after turning off the contact switch 11.

Note that, the first switch block 1 includes two contact switches 11 and two semiconductor switches 12, and therefore is allowed to individually control the loads individually connected to the two pairs (two circuits) of the power terminal 7 and the load terminal 8.

Figure 4:
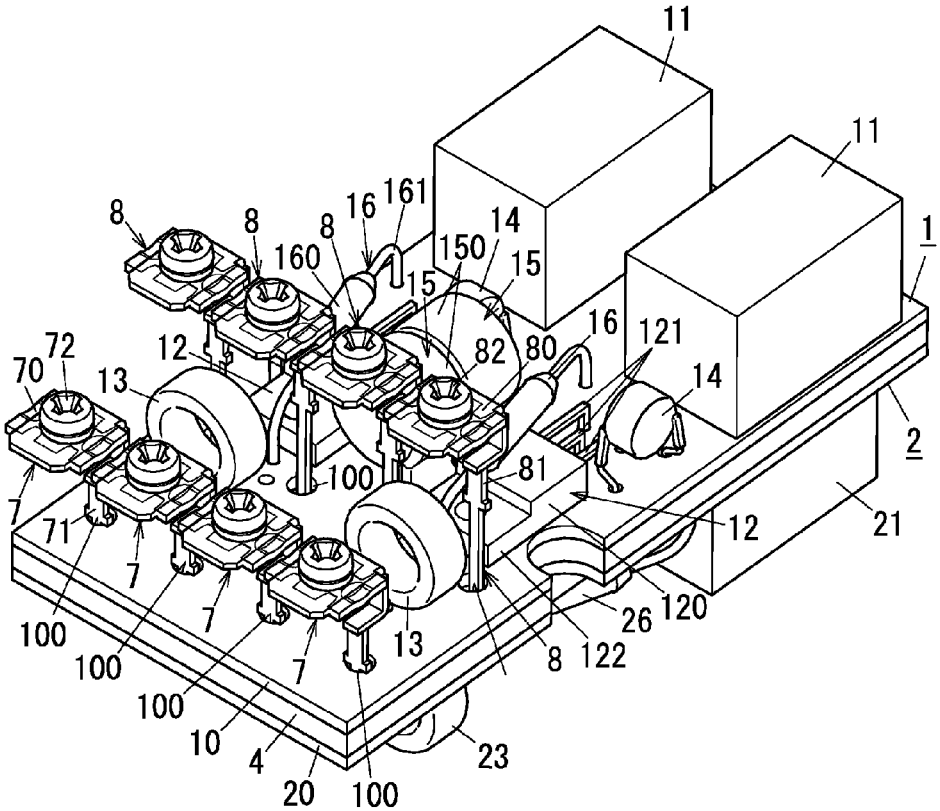
FIG. 4 is a perspective view illustrating the first switch block, the second switch block, the insulating member, the power supply terminals, and the load terminals of the blinking device in accordance with the embodiment of the present invention.

As shown in FIG. 2 and FIG. 4, the printed wiring board 10 has a rectangular shape with a length direction along the forward and rearward direction, and the two contact switches 11 are arranged in the left and right direction and mounted on the rear end of the front face (upper face) the printed wiring board 10. Further, the circuit parts such as the semiconductor switches 12, the inductors 13, the capacitors 14, the varistors 15, and the temperature fuses 16 are divided into a left and right pairs (circuits), and circuit parts in each pair are mounted to be arranged in the forward and rearward direction.

The semiconductor switch 12 has a package structure in which three lead terminals 121 protrude from one end face of a resin mold part 120 and a heat dissipation plate 122 in a rectangular plate shape protrudes from the other end face of the resin mold part 120. This package is a so-called TO (Transistor Outline) package. As shown in FIG. 4, the lead terminals 121 of this semiconductor switch 12 are bent at about 90 degrees and are inserted into through holes of the printed wiring board 10. Additionally, this semiconductor switch 12 is mounted so that the resin mold part 120 and the heat dissipation plate 122 are in contact with the front face of the printed wiring board 10. Note that, the resin mold part 120 and the heat dissipation plate 122 may be spaced from the front face of the printed wiring board 10.

Further, as for the temperature fuse 16, lead terminals 161 protruding from opposite ends of a body 160 in an almost cylindrical shape are bent at about 90 degrees, and the temperature fuse 16 is mounted to the printed wiring board 10 so that the body 160 is in contact with an upper face of the resin mold part 120 of the semiconductor switch 12. By making the body 160 of the temperature fuse 16 be in contact with the resin mold part 120 of the semiconductor switch 12, the accuracy of sensing, by the temperature fuse 16, the temperature of the semiconductor switch 12 can be improved. Additionally, the semiconductor switch 12 is mounted on the printed wiring board 10 while being laid down. Therefore, a height of the first switch block 1 can be limited not to exceed a height of the upper face of the contact switch 11.

Figure 7:
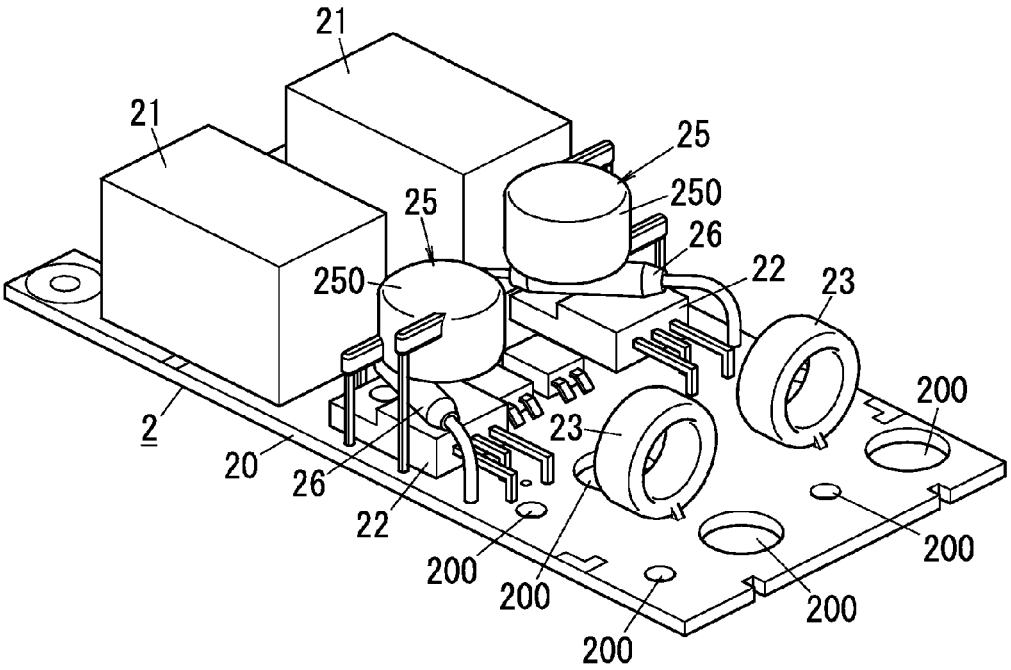
FIG. 7 is a perspective view illustrating another configuration of the second switch block of the blinking device in accordance with the embodiment of the present invention.

Further, the varistor 15 is mounted on an almost center of the printed wiring board 10 while two lead terminals protruding from a hollow-cylindrical resin mold part 150 are inserted into through holes. With regard to the front face of the printed wiring board 10, the varistor 15 is situated close to the temperature fuse 16, and therefore the temperature of the varistor 15 can be sensed by the temperature fuse 16. Note that, to improve the accuracy of sensing the temperature of the varistor 15 by the temperature fuse 16, it is preferable that as shown in FIG. 7 the varistor 15 is situated above the temperature fuse 16 and the resin mold part 150 of the varistor 15 is made to be in contact with the temperature fuse 16. Note that, FIG. 7 shows the configuration of the second switch block 2. Hence, in the above explanation referring to FIG. 7, a temperature fuse 26, a varistor 25, and a resin mold part 250 are replaced with the temperature fuse 16, the varistor 15, and the resin mold part 150, respectively.

Figure 5:
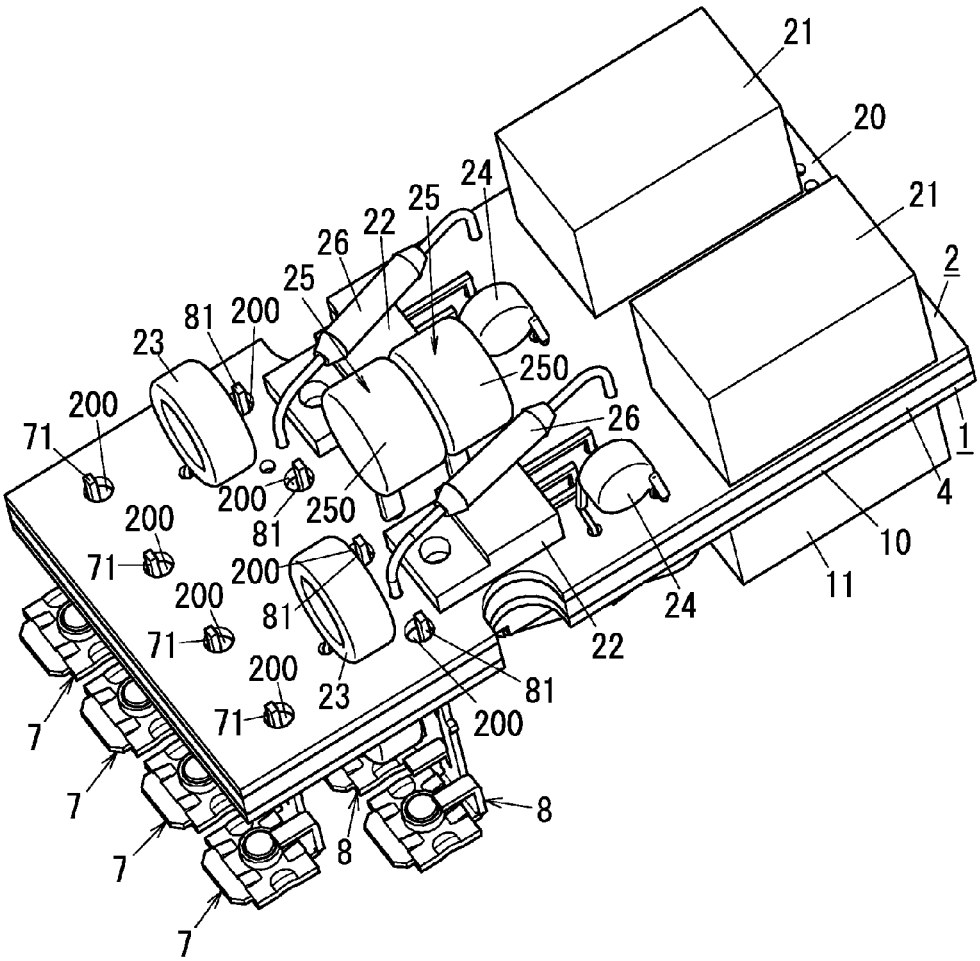
FIG. 5 is a perspective view illustrating the first switch block, the second switch block, the insulating member, the power supply terminals, and the load terminals of the blinking device in accordance with the embodiment of the present invention.

As shown in FIG. 5, the second switch block 2 may be constituted by a printed wiring board (mounting substrate) 20, at least one mechanical contact switch 21, at least one semiconductor switch 22, at least one inductor 23, at least one capacitor 24, at least one varistor 25, and at least one temperature fuse 26, as with the first switch block 1. On a front face (upper face in FIG. 5) of the printed wiring board 20, two contact switches 21, two semiconductor switches 22, two inductors 23, two capacitors 24, two varistors 25, and two temperature fuses 26 are mounted. Additionally, a patterned conductor of the printed wiring board 20 and the control circuit block 3 are electrically connected via a flat cable 27 (see FIG. 1).

As apparent from the above, the second switch block 2 has substantially the same configuration (including used circuit parts, the patterned conductors of the printed wiring board 20, and the like) as the first switch block 1, and therefore detailed explanations of the configuration of the second switch block 2 are omitted.

Figure 1:
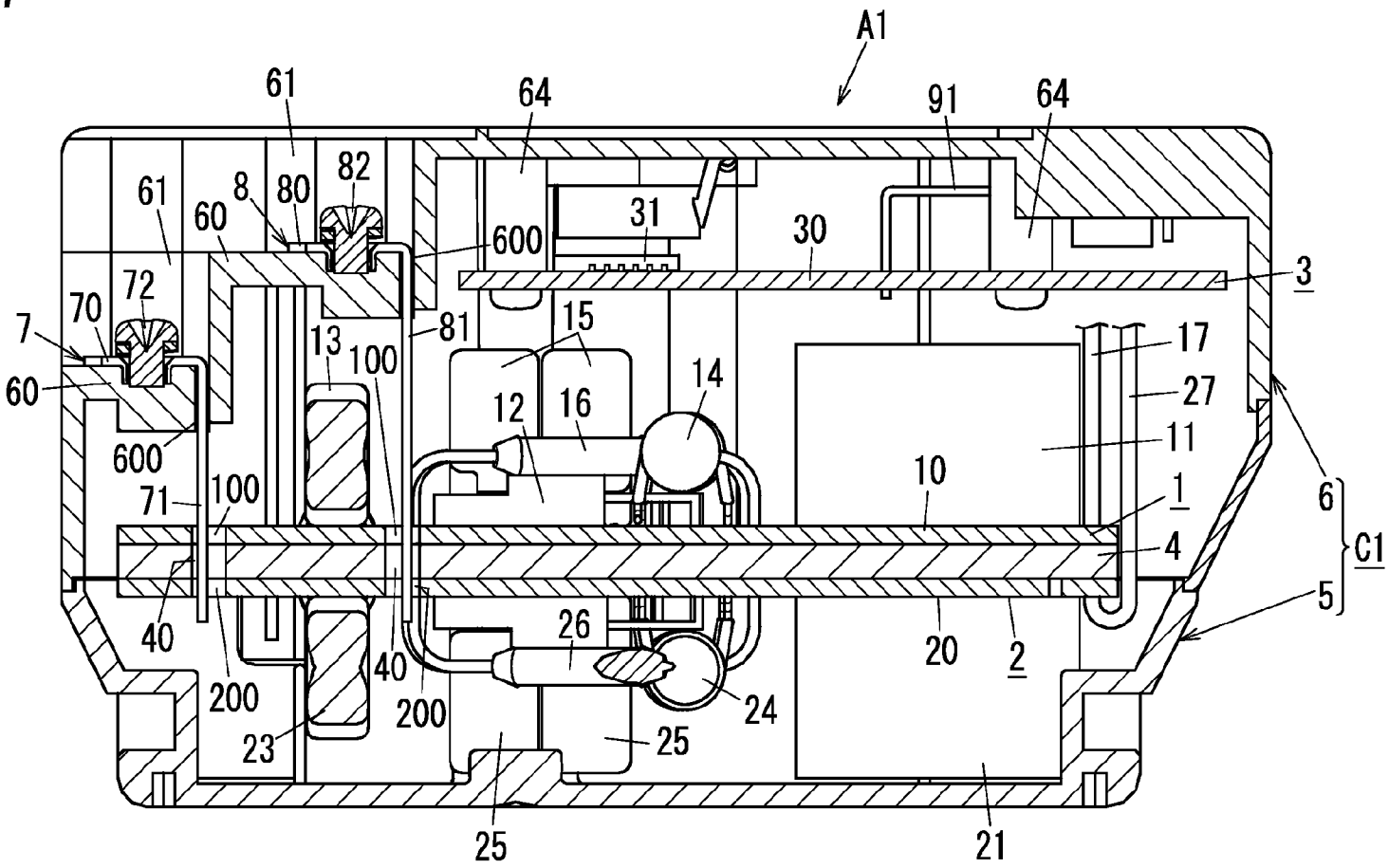
FIG. 1 is a section illustrating the blinking device in accordance with the embodiment of the present invention.

The first switch block 1 and the second switch block 2 which are described above are accommodated in the case C1 so that the printed wiring boards 10 and 20 face each other while the insulating member in the form of sheet is situated therebetween (see FIG. 1). The insulating member 4 has a sheet shape and is made of material (e.g., heat dissipation silicone rubber) which is higher in thermal conductivity than general synthetic rubber. Note that, in the blinking device A1 of the present embodiment, the insulating member 4 and the printed wiring boards 10 and 20 are made to have the same length and width dimensions. However, it is not always necessary to make the insulating member 4 equal to the printed wiring boards 10 and 20 in both the length and width dimensions. Note that, the length and width dimensions are a dimension in the forward and rearward direction and a dimension in the left and right direction.

As shown in FIG. 4, the insulating member 4 is situated between the two printed wiring boards 10 and 20 so that an upper face of the insulating member 4 is in contact with the rear face of the printed wiring board 10 of the first switch block 1 and a lower face of the insulating member 4 is in contact with the rear face of the printed wiring board 20 of the second switch block 2. Note that, the insulating member 4 is made of elastic material with relatively high thermal conductivity, and therefore increases in temperatures of the switch blocks 1 and 2 can be suppressed even if the insulating member 4 has a relatively small volume.

The following explanation is made to connection structures for electrically connecting the power terminal 7 and the load terminal 8 to the first switch block 1 and the second switch block 2. Note that, the power terminal 7 and the load terminal 8 have the same connection structure, and therefore only the connection structure of the power terminal 7 is described hereinafter but the connection structure of the load terminals 8 is not described for avoiding redundant explanations.

There are eight through holes 100 penetrating through a front end part of the printed wiring board 10 of the first switch block 1, and there are eight through holes 200 penetrating through a front end part of the printed wiring board 20 of the second switch block 2 (see FIG. 2). The eight through holes 100 are divided into two pairs of the four through holes 100 and these two pairs are arranged in the forward and rearward direction. The eight through holes 200 are divided into two pairs of the four through holes 200 and these two pairs are arranged in the forward and rearward direction. In each pair, the four through holes 100 are arranged at regular intervals in the left and right direction. In each pair, the four through holes 200 are arranged at regular intervals in the left and right direction. Additionally, there are eight through holes 40 penetrating through a front end part of the insulating member 4. The eight through holes 40 are divided into two pairs of the four through holes 40 and these two pairs are arranged in the forward and rearward direction. Further, in each pair, the four through holes 40 are arranged at regular intervals in the left and right direction. When the insulating member 4 is situated between the first switch block 1 and the second switch block 2, the through holes 100 and 200 of the two printed wiring boards 10 and 20 are connected to the through holes 40 of the insulating member 4 in the upward and downward direction, individually. The insertion part 71 of the power terminal 7 is inserted, from above to below, into the three through holes 100, 200, and 40 which are connected to each other in the upward and downward direction (see FIG. 4). Note that, as shown in FIG. 5, a front end of the insertion part 71 protrudes from the front face (upper face) of the printed wiring board 20.

The first switch block 1 is electrically and mechanically connected to two of the power terminals 7 by connecting with solder the insertion parts 71 to patterned conductors which are formed on the front face of the printed wiring board 10 and individually surround the leftmost through hole 100 and the third through hole 100 from the left in the front pair of the two pairs. In contrast, with regard to the second switch block 2, the insertion parts 71 are connected with solder to patterned conductors which are formed on the front face of the printed wiring board 20 and individually surround the rightmost (leftmost in FIG. 5) through hole 200 and the third through hole 200 from the right (in FIG. 5, the third through hole 200 from the left) in the front pair of the two pairs. As a result, the second switch block 2 is electrically and mechanically connected to the other two of the power terminals 7. In more details, a land (not shown) connected to a patterned conductor is formed to surround the through hole 100 in the front face and the rear face of the printed wiring board 10, or the through hole 200 in the front face and the rear face of the printed wiring board 20. The insertion part 71 is connected to such a land with solder. In other words, regarding the blinking device A1 of the present embodiment, a land formed to surround the through hole 100, 200 serves as a connector.

The insertion parts 71 and 81 of the power terminals 7 and the load terminals 8 attached to the cover 6 are inserted into the through holes 100 of the printed wiring board 10 of the first switch block 1, and then the insertion parts 71 and 81 are connected to the lands on the rear face of the printed wiring board 10 with solder. The insulating member 4 is situated on the rear face of the printed wiring board 10, and then the insertion parts 71 and 81 are inserted into the through holes 200 of the printed wiring board 20 of the second switch block 2, and subsequently the insertion parts 71 and 81 are connected to the lands on the front face of the printed wiring board 20 with solder. By this procedure, the first and second switch blocks 1 and 2 can be accommodated in the cover 6, and the power terminals 7 and the load terminals 8 can be electrically connected to the first and second switch blocks 1 and 2.

As shown in FIG. 7, with regard to the printed wiring board 20 of the second switch block 2, the four through holes 200 which are of the eight through holes 200 and allow insertion of the insertion parts 71 and 81 not connected to the patterned conductors of the printed wiring board 20 with solder may be larger in diameter than the remaining four through holes 200.

Figure 8:
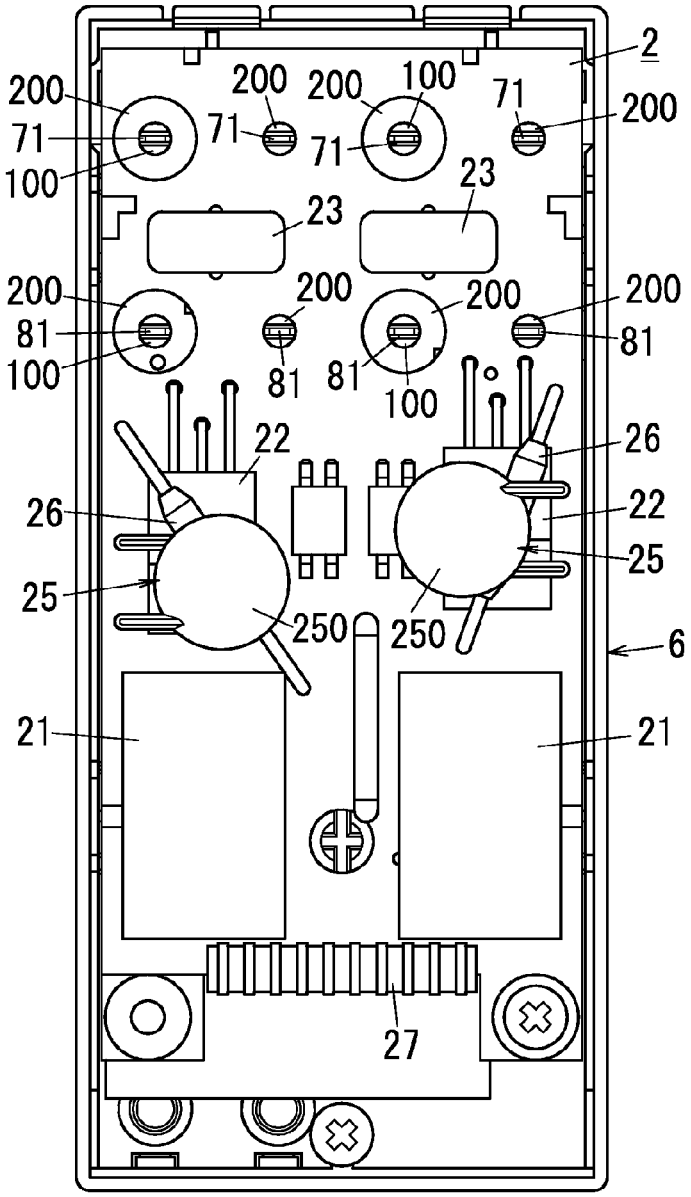
FIG. 8 is a plan illustrating another configuration of the second switch block of the blinking device in accordance with the embodiment of the present invention while the body is detached.

As shown in FIG. 8, the through holes 100 of the printed wiring board 10 of the first switch block 1 are exposed on the front face of the printed wiring board 20 of the second switch block 2 through the through holes 200 with large diameters. Therefore, after the insertion parts 71 and 81 of the power terminals 7 and the load terminals 8 are inserted into the through holes 100 and 200 of the printed wiring boards 10 and 20, it is possible to connect the insertion parts 71 and 81 to the lands on the rear face of the printed wiring board 10 with solder through the through holes 200 with large diameters from below the lower surface (open face) of the cover 6. In short, the lands of the printed wiring boards 10 and 20 can be connected to the insertion parts 71 and 81 with solder at one time while the first and second switch blocks 1 and 2 are accommodated in the cover 6. Therefore, the working process can be simplified.

As shown in FIG. 2, the control circuit block 3 is produced by mounting circuit parts constituting a control circuit on the front face (or a rear face, or both front and rear faces) of a printed wiring board (control substrate) 30. This control circuit includes an integrated circuit 32. The integrated circuit 32 sends transmission signals to and receives transmission signals from an external device through signal lines connected to the signal terminals 9. Further, the integrated circuit 32 performs controls on the first switch block 1 and the second switch block 2 (on and off controls on the contact switches 11 and 21) based on control commands included in the received transmission signals. Moreover, there is a dip switch 31 mounted on the front face (upper face) of the printed wiring board 30. The dip switch 31 is used for setting an address necessary for sending and receiving the transmission signals. As shown in FIG. 1, the control circuit block 3 is attached to the cover 6 by being screwed to bosses 64 protruding from an inner bottom (upper face in an inside) of the cover 6.

As described above, in the blinking device A1 of the present embodiment, the contact switches 11 and 21 are mounted on the two printed wiring boards 10 and 20, respectively. Therefore, in contrast to a case where contact switches are mounted on the same face of one printed wiring board as with the conventional example disclosed in document 1, the blinking device A1 of the present embodiment allows downsizing of the printed wiring boards 10 and 20. Additionally, these two printed wiring boards 10 and 20 are accommodated in the case C1 so as to be stacked in the thickness direction (upward and downward direction), and the blinking device A1 of the present embodiment also allows downsizing of the case C1.

Figure 9:
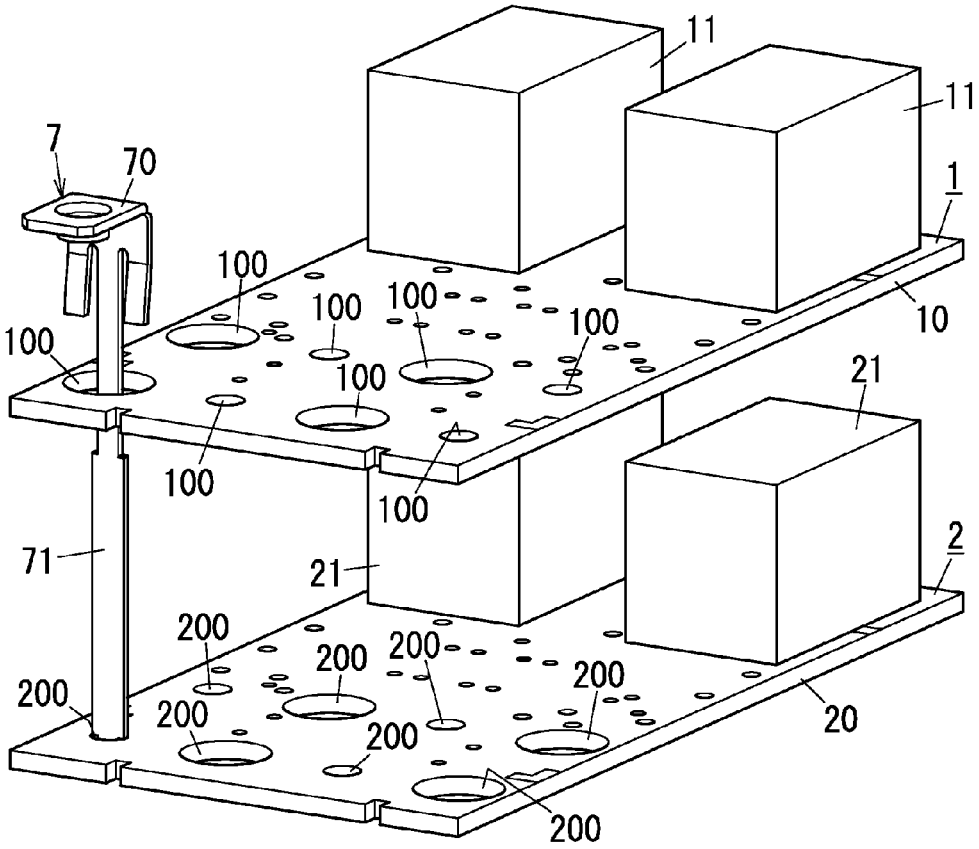
FIG. 9 is a perspective view illustrating the primary part of another configuration of the blinking device in accordance with the embodiment of the present invention.

Note that, as shown in FIG. 9, the first switch block 1 and the second switch block 2 may be stacked to be directed in the same direction. However, when the first switch block 1 and the second switch block 2 are be stacked to be directed in the same direction, a space between the two printed wiring boards 10 and 20 becomes a dead space. Hence, to downsize the case C1, it is preferable to stack the first switch block 1 and the second switch block 2 to be directed to opposite directions as described above.

Figure 10:
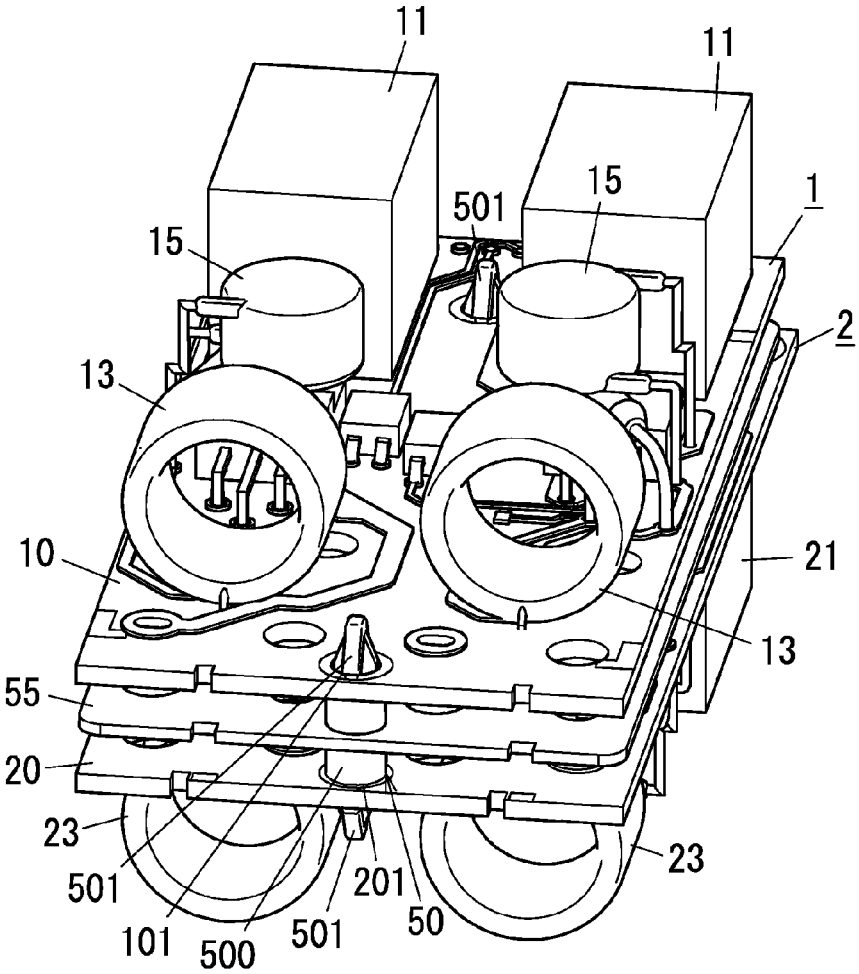
FIG. 10 is a perspective view illustrating the primary part of yet another configuration of the blinking device in accordance with the embodiment of the present invention.

Additionally, as shown in FIG. 10, the two printed wiring boards 10 and 20 may be held by two spacers 50 so that a distance between the printed wiring boards 10 and 20 is kept constant. The spacer 50 includes a cylindrical body 500 and a pair of engaging parts 501 protruding from opposite ends of the body 500, and the body 500 and the pair of engaging parts 501 are formed integrally as a synthetic resin molded product.

The printed wiring board 10 includes engaging holes 101 penetrating through front and rear ends of its center part in the left and right direction, and the printed wiring board 20 includes engaging holes 201 penetrating through front and rear ends of its center part in the left and right direction. The engaging parts 501 are inserted into and engaged with these engaging holes 101 and 102 and thereby the spacers 50 are fixed to the printed wiring boards 10 and 20. As a result, the first switch block 1 and the second switch block 2 are held by the spacers 50 so as to be spaced at a predetermined interval (equal to a length of the body 500 in an axial direction thereof). Alternatively, the engaging parts 501 may be replaced with screw holes formed in the opposite end faces of the body 500, and the spacers 50 may be screwed to the printed wiring boards 10 and 20. Note that, in the configuration shown in FIG. 10, to ensure an insulating distance, an insulating plate 55 which is made of electrically insulating material and is in a rectangular plate shape is situated between the two printed wiring boards 10 and 20.

As described above, the blinking device A1 of the present embodiment includes the following first feature.

In the first feature, the blinking device A1 of the present embodiment includes the multiple power terminals 7, the multiple load terminals 8, the multiple contact switches 11, 21, the control circuit block 3 (control circuit), the multiple printed wiring boards 10, 20 (mounting substrates), and the case C1 in a box shape. The multiple power terminals 7 are to be connected to a power supply (AC power source). The multiple load terminals 8 are individually to be connected to different loads (not shown). The multiple contact switches 11, 21 are individually provided to multiple power supply paths each connected to a pair of one of the power terminals 7 and one of the load terminals 8. The control circuit block 3 is configured to turn on and off the contact switches 11, 21. At least one contact switch 11, 21 is mounted on each of the multiple printed wiring boards 10, 20. The case C1 is configured to accommodate therein the power terminals 7, the load terminals 8, the control circuit block 3, and the printed wiring boards 10, 20. In the multiple printed wiring boards 10, 20, the power supply path(s) is formed on at least one of a front face where the contact switch 11, 21 is mounted, and a rear face where the contact switch 11, 21 is not mounted. The case C1 is configured to accommodate the multiple printed wiring boards 10, 20 so that the multiple printed wiring boards 10, 20 are stacked in a thickness direction.

In other words, the blinking device A1 of the present embodiment includes multiple power terminals 7, multiple load terminals 8, multiple contact switches 11, 21, a control circuit block 3 (control circuit), multiple printed wiring boards 10, 20 (mounting substrates), and a case C1 in a box shape. The multiple power terminals 7 are to be connected to a power supply (AC power source). The multiple load terminals 8 are individually to be connected to different loads (not shown). The multiple contact switches 11, 21 are individually associated with multiple power supply paths individually connected to multiple pairs each defined as a pair of one power terminal 7 of the multiple power terminals 7 and one load terminal 8 of the multiple load terminals 8. The control circuit block 3 is for turning on and off the multiple contact switches 11, 21. At least one contact switch 11, 21 of the multiple contact switches 11, 21 is mounted on each of the multiple printed wiring boards 10, 20. The case C1 is for accommodating therein the multiple power terminals 7, the multiple load terminals 8, the control circuit block 3, and the multiple printed wiring boards 10, 20. At least one power supply path of the multiple power supply paths is formed on at least one of a front face, where at least one contact switch 11, 21 is mounted, and a rear face, where no contact switch 11, 21 is mounted, of each of the multiple printed wiring boards 10, 20. The case C1 is configured to accommodate the multiple printed wiring boards 10, 20 so that the multiple printed wiring boards 10, 20 are stacked in a thickness direction.

Further, the blinking device A1 of the present embodiment may include the following second feature realized in combination with the first feature.

In the second feature, the case C1 is configured to accommodate the adjacent two printed wiring boards 10, 20 so that the rear faces of the adjacent two printed wiring boards 10, 20 face each other.

In other words, the case C1 is configured to accommodate adjacent two printed wiring boards 10, 20 of the multiple printed wiring boards 10, 20 so that the rear faces of the adjacent two printed wiring boards 10, 20 face each other.

Further, the blinking device A1 of the present embodiment may include the following third feature realized in combination with the first or second feature.

In the third feature, the power terminal 7 includes the power supply dedicated terminal plate 70 and the insertion part 71. The power supply dedicated terminal plate 70 is to be connected to a power supply cable (not shown). The insertion part 71 is inserted into the through hole 100, 200 penetrating through the printed wiring board 10, 20 in a thickness direction. The load terminal 8 includes the load dedicated terminal plate 80 and the insertion part 81. The load dedicated terminal plate 80 is to be connected to a load cable (not shown). The insertion part 81 is inserted into the through hole 100, 200 penetrating through the printed wiring board 10, 20 in a thickness direction. The printed wiring board 10, 20 includes a connector which allows insertion of the insertion part 71, 81 inserted into the through hole 100, 200 of the other printed wiring board 10, 20 and is part of its power supply path and is electrically connected to the insertion part 71, 81.

In other words, each of the multiple power terminals 7 includes a power supply dedicated terminal plate 70 and an insertion part 71. The power supply dedicated terminal plate 70 is to be connected to a power supply cable (not shown). The insertion part 71 is inserted into a through hole 100, 200 penetrating through a corresponding one of the multiple printed wiring boards 10, 20 in a thickness direction. Each of the multiple load terminals 8 includes a load dedicated terminal plate 80 and an insertion part 81. The load dedicated terminal plate 80 is to be connected to a load cable (not shown). The insertion part 81 is inserted into a through hole 100, 200 penetrating through a corresponding one of the multiple printed wiring boards 10, 20 in a thickness direction. Each of the multiple printed wiring boards 10, 20 includes a land (connector) electrically connected to the at least one power supply path. The land of one printed wiring board 10, 20 allows insertion of an insertion part 71, 81 from a different printed wiring board 10, 20 and is electrically connected to the insertion part 71, 81 from the different printed wiring board 10, 20.

Further, the blinking device A1 of the present embodiment may include the following fourth feature realized in combination with the second or third feature.

In the fourth feature, an insulating member 4 is situated between the two printed wiring boards 10, 20.

Further, the blinking device A1 of the present embodiment may include the following fifth feature realized in combination with any one of the first to fourth features.

In the fifth feature, the through hole 100, 200 of one of the printed wiring boards 10, 20 allows exposure of the connector of another of the printed wiring boards 10, 20.

In other words, the through hole 100, 200 of one printed wiring board 10, 20 of adjacent two printed wiring boards 10, 20 of the multiple printed wiring boards 10, 20 exposes the connector of the other printed wiring board 10, 20.

Further, the blinking device A1 of the present embodiment may include the following sixth feature realized in combination with any one of the first to fifth features.

In the sixth feature, the blinking device A1 of the present embodiment further includes a spacer 50 for keeping a distance between the two printed wiring boards 10, 20 constant.

Further, the blinking device A1 of the present embodiment may include the following seventh feature realized in combination with any one of the first to sixth features.

In the seventh feature, the blinking device A1 of the present embodiment includes a printed wiring board (control substrate) 30. Multiple circuit parts constituting the control circuit block 3 are mounted on the printed wiring board 30, and a conduction path electrically interconnecting the multiple circuit parts is formed on a surface of the printed wiring board 30. The power supply path is made of a copper foil thicker than a copper foil for forming the conduction path.

In other words, the blinking device A1 of the present embodiment further includes a printed wiring board (control substrate) 30. Multiple circuit parts constituting the control circuit block 3 are mounted on the printed wiring board 30, and a conduction path electrically interconnecting the multiple circuit parts is formed on a surface of the printed wiring board 30. Each of the multiple power supply paths is made of a copper foil thicker than a copper foil for forming the conduction path.

Further, the blinking device A1 of the present embodiment may include the following eighth feature realized in combination with any one of the first to seventh features.

In the eighth feature, the semiconductor switch 12, 22 connected in parallel with the contact switch 11, 21 is mounted on the printed wiring board 10, 20.

In other words, a semiconductor switch 12, 22 connected in parallel with a corresponding one of the multiple contact switches 11, 21 is mounted on each of the multiple printed wiring boards 10, 20.

Further, the blinking device A1 of the present embodiment may include the following ninth feature realized in combination with the eighth feature.

In the ninth feature, the blinking device A1 of the present embodiment includes the temperature fuse 16, 26 (temperature sensing element) for sensing a temperature of the semiconductor switch 12, 22. The semiconductor switch 12, 22 is situated so that its length direction is parallel to the front face of the printed wiring board 10, 20. The temperature fuse 16, 26 is mounted on the front face of the printed wiring board 10, 20 with the semiconductor switch 12, 22 in-between so that its length direction is parallel to the front face of the printed wiring board 10, 20.

In other words, the blinking device A1 of the present embodiment includes a temperature fuse 16, 26 (temperature sensing element) for sensing a temperature of the semiconductor switch 12, 22. The semiconductor switch 12, 22 is situated so that a length direction of the semiconductor switch 12, 22 is parallel with the front face of a corresponding one of the multiple mounting substrates 10, 20. The temperature fuse 16, 26 is mounted on the front face of the corresponding one of the multiple printed wiring boards 10, 20 with the semiconductor switch 12, 22 in-between so that a length direction of the temperature fuse 16, 26 is parallel with the front face of the corresponding one.

Further, the blinking device A1 of the present embodiment may include the following tenth feature realized in combination with the ninth feature.

In the tenth feature, the semiconductor switch 12, 22 has a face which faces the front face and is in contact with this front face.

In other words, the semiconductor switch 12, 22 includes a face which faces the front face of the corresponding one of the multiple printed wiring boards 10, 20 and is in contact with this front face.

Further, the blinking device A1 of the present embodiment may include the following eleventh feature realized in combination with any one of the eighth to tenth features.

In the eleventh feature, the blinking device A1 of the present embodiment includes a varistor 15, 25 (overvoltage protection element), and a temperature fuse 16, 26 (second temperature sensing element). The varistor 15, 25 is for protecting the semiconductor switch 12, 22 from overvoltage. The temperature fuse 16, 26 is for sensing a temperature of the varistor 15, 25.

Further, the blinking device A1 of the present embodiment may include the following twelfth feature realized in combination with the eleventh feature.

In the twelfth feature, in the blinking device A1 of the present embodiment, the temperature fuse 16, 26 for sensing the temperature of the varistor 15, 25 doubles as the temperature fuse 16, 26 for sensing the temperature of the semiconductor switch 12, 22.

Further, the blinking device A1 of the present embodiment may include the following thirteen feature realized in combination with any one of the first to twelfth features.

In the thirteenth feature, the printed wiring boards 10 and 20 each include patterned copper foils including power supply paths formed on both the front face and the rear face.

In other words, at least one patterned copper foil including the at least one multiple power supply paths is formed on each of the front face and the rear face of each of the multiple printed wiring boards 10, 20.

As apparent from the aforementioned present embodiment, in the present invention, the contact switches 11, 21 are mounted on the multiple printed wiring boards 10, 20, and these multiple printed wiring boards 10, 20 are accommodated in the case C1 so as to be stacked in the thickness direction. Therefore, in contrast to a case where multiple contact switches are mounted on the same face of one printed wiring board as with the conventional example disclosed in document 1, the present invention gives advantageous effects of allowing independent starting and ending of power supply to multiple loads, and also allowing downsizing.

The invention claimed is:

1. A blinking device, comprising:

multiple power terminals to be connected to a power supply;

multiple load terminals to be individually connected to different loads;

multiple contact switches individually associated with multiple power supply paths individually connected to multiple pairs each defined as a pair of one power terminal of the multiple power terminals and one load terminal of the multiple load terminals;

a control circuit for turning on and off the multiple contact switches;

multiple mounting substrates each on which at least one contact switch of the multiple contact switches is mounted; and a case in a box shape for accommodating therein the multiple power terminals, the multiple load terminals, the control circuit, and the multiple mounting substrates, at least one power supply path of the multiple power supply paths being formed on at least one of a front face, where at least one contact switch is mounted, and a rear face, where no contact switch is mounted, of each of the multiple mounting substrates, and the case being configured to accommodate the multiple mounting substrates so that the multiple mounting substrates are stacked in a thickness direction of each of the multiple mounting substrates.

2. The blinking device according to claim 1, wherein the case is configured to accommodate adjacent two mounting substrates of the multiple mounting substrates so that the rear faces of the adjacent two mounting substrates face each other.

3. The blinking device according to claim 1, wherein:

each of the multiple power terminals includes a power supply dedicated terminal plate to be connected to a power supply cable, and an insertion part inserted into through holes individually penetrating through the multiple mounting substrates in a thickness direction;

each of the multiple load terminals includes a load dedicated terminal plate to be connected to a load cable, and an insertion part inserted into through holes individually penetrating through the multiple mounting substrates in a thickness direction;

each of the multiple mounting substrates includes a connector electrically connected to the at least one power supply path; and the connector of one mounting substrate allows insertion of an insertion part from a different mounting substrate and is electrically connected to the insertion part from the different mounting substrate.

4. The blinking device according to claim 2, wherein an insulating member is situated between the two mounting substrates.

5. The blinking device according to claim 3, wherein the through hole of one mounting substrate of adjacent two mounting substrates of the multiple mounting substrates exposes the connector of the other mounting substrate.

6. The blinking device according to claim 2, further comprising a spacer for keeping a distance between the two mounting substrates constant.

7. The blinking device according to claim 1, further comprising a control substrate, wherein:

multiple circuit parts constituting the control circuit are mounted on the control substrate;

a conduction path electrically interconnecting the multiple circuit parts is formed on a surface of the control substrate; and each of the multiple power supply paths is made of a copper foil thicker than a copper foil for forming the conduction path.

8. The blinking device according to claim 1, wherein a semiconductor switch connected in parallel with a corresponding one of the multiple contact switches is mounted on each of the multiple mounting substrates.

9. The blinking device according to claim 8, further comprising a temperature sensing element for sensing a temperature of the semiconductor switch, wherein:

the semiconductor switch is situated so that a length direction of the semiconductor switch is parallel with the front face of a corresponding one of the multiple mounting substrates; and the temperature sensing element is mounted on the front face of the corresponding one of the multiple mounting substrates with the semiconductor switch in-between so that a length direction of the temperature sensing element is parallel with the front face of the corresponding one.

10. The blinking device according to claim 9, wherein the semiconductor switch includes a face which faces the front face of the corresponding one of the multiple mounting substrates and is in contact with this front face.

11. The blinking device according to claim 9, further comprising:

an overvoltage protection element for protecting the semiconductor switch from overvoltage; and a second temperature sensing element for sensing a temperature of the overvoltage protection element.

12. The blinking device according to claim 11, wherein the temperature sensing element doubles as the second temperature sensing element.

13. The blinking device according to claim 1, wherein at least one patterned copper foil including the at least one multiple power supply paths is formed on each of the front face and the rear face of each of the multiple mounting substrates.

* * * * *